United States Patent [19]

Sims

[11] 4,089,416

[45] May 16, 1978

[54] UMBRELLA TIP REPAIR KIT

[76] Inventor: Joseph Wade Sims, 7139 Mt. Vernon St., Pittsburgh, Pa. 15208

[21] Appl. No.: 780,033

[22] Filed: Mar. 22, 1977

[51] Int. Cl.[2] ..... B65D 69/00

[52] U.S. Cl. ..... 206/582; 135/36 F; 135/36 RT; 224/5.1; 229/72

[58] Field of Search ..... 135/8, 34, 36 R, 36 F, 135/36 RT; 224/260, 5.1; 229/56, 72; 206/582, 574, 223, 231; 190/60

[56] References Cited

U.S. PATENT DOCUMENTS

| | | | |
|---|---|---|---|
| 721,049 | 2/1903 | Kern | 135/36 RT |
| 1,629,404 | 5/1927 | Mitchell | 224/26 D |
| 2,504,221 | 4/1950 | Ornstein et al. | 135/36 RT |
| 2,542,620 | 2/1951 | Bloomberg | 135/36 RT |
| 2,710,709 | 6/1955 | Bowers | 206/223 |
| 3,000,387 | 9/1961 | Tibony | 135/36 RT |
| 3,223,233 | 12/1965 | Becker et al. | 229/56 |
| 3,516,598 | 6/1970 | Martins | 229/72 |
| 3,717,297 | 2/1973 | Perry | 229/72 |
| 3,873,821 | 3/1975 | Larson | 135/34 |

FOREIGN PATENT DOCUMENTS

| | | | |
|---|---|---|---|
| 664,038 | 1/1952 | United Kingdom | 135/36 RT |

*Primary Examiner*—William Price
*Assistant Examiner*—Bruce H. Bernstein
*Attorney, Agent, or Firm*—Buell, Blenko & Ziesenheim

[57] ABSTRACT

A kit for easy and rapid repair, without tools, of umbrella tips from which the fabric covering has become loosened, torn, or otherwise separated. The kit comprises a short section of plastic tube, a conical cap having a threaded bore, and a small envelope for carrying several sets of the tubes and caps. In use, the plastic tube is expanded over the tip end of the umbrella rib, then a section of the covering is placed over and around the tube, and finally the conical cap is manually screwed over the tube to hold the covering tightly in place on the end of the umbrella rib. Several tubes and caps are preferably carried in the envelope which is secured interiorly around an umbrella rib, thus making the kit immediately available for use.

5 Claims, 8 Drawing Figures

UMBRELLA TIP REPAIR KIT

This invention, bearing Disclosure Document No. 43,998, relates to a repair kit for attaching, without the use of any tools, an umbrella cover to the tip of an umbrella rib from which it has become torn or otherwise separated.

Due to use in service or for other reasons, the fabric cover of an umbrella quite often becomes torn or separated from the tip of the rib to which it was attached. Without special tools or needle and thread being available, there is no alternative but to use the umbrella without re-attachment of the cover to the rib. Even if there remains sufficient area of the unbrella cover to protect the user from rain, the appearance of the umbrella is nevertheless unsightly and the cover is likely to become torn or damaged. Moreover, the exposed rib end is a means of potential injury to passersby.

It is an object of my invention, therefore, to provide a kit for readily and quickly re-attaching an umbrella cover to the tip end of a rib from which it has become separated, especially without the need for any tools of any kind.

I am aware of prior art patents pertinent to this subject, such as U.S. Pat. Nos. 1,007,320; 1,060,712; and 1,336,218. However, in all cases, special tools or instruments are required for securing the umbrella cover to the tip end of the rib.

The kit which I provide has the advantage over the prior art devices in that no tools of any kind are required, the parts are simple in construction and of low cost, and comprises a small carrying envelope sealable around the rib of an umbrella so as to render the attaching parts of the kit constantly and immediately available. The attaching parts of the kit comprise a short section of flexible tube or "spaghetti" of plastic material, for example, and a rigid cap or tip having a threaded bore. In use, the tube is manually slipped over the free end of an umbrella rib, a small section of the umbrella cover is then placed over and partially surrounding the tube and finally the cap is screwed over the tube and cover to securely attach the cover to the umbrella rib.

Figure 1:
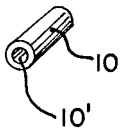
Figure 2:
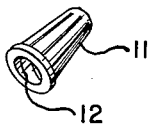
Figure 3:
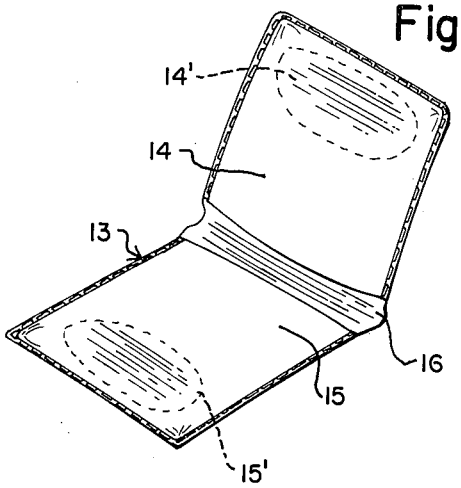
Figure 4:
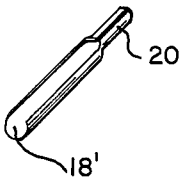
Figure 5:
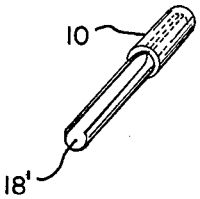
Figure 6:
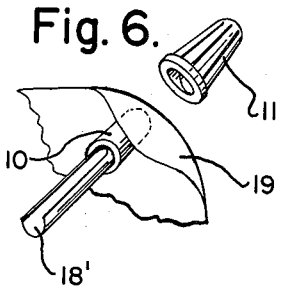
Figure 7:
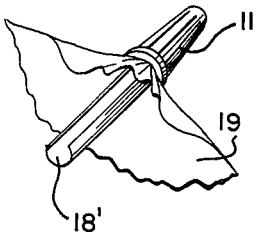
Figure 8:
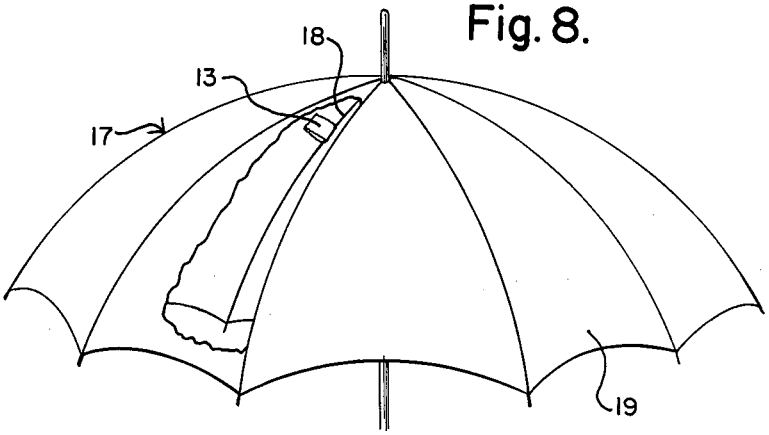

A preferred embodiment of my invention is hereafter more fully described in connection with the accompanying drawings, wherein:

FIGS. 1 and 2 are perspective views, respectively of the short section of tube and screw cap included in my novel repair kit, FIG. 3 is a view of the fold-over envelope with pockets for carrying several sets of the attaching parts, shown in FIGS. 1 and 2, FIGS. 4 and 5 are perspective views of the tip end of an umbrella rib, respectively showing the rib, before and after installation thereon of the short section of tube, FIG. 6 is a view showing an edge of the fabric cover of the umbrella over the section of tube on the umbrella tip, with a screw cap in position preparatory to screwing it over the tube, FIG. 7 is a view showing the screw cap in final installed position on the tip of the umbrella rib securely anchoring the fabric cover in place, FIG. 8 is a fragmental view of an umbrella, in raised position, and with a portion of the cover broken away, showing the manner in which the kit envelope is interiorly sealed in surrounding relation to a rib of the umbrella.

Referring to FIGS. 1, 2 and 3 of the drawings, the parts of my novel repair kit are respectively shown. In FIG. 1 is shown a short (approximately three-eighths inch) section of tubing, hereinafter called tube 10, of flexible resilient material such as clear plastic, sometimes referred to as "spaghetti". In FIG. 2 is shown a screw cap 11 of semi-rigid plastic material having a bore 12 therein preferably tapering slightly toward the closed end and having threads therein.

In FIG. 3, an envelope 13 is shown, having two opposing pockets 14 and 15, one large enough to hold several sets of tubes 10 and caps 11 and the other to hold, by way of example, advertising material or an identification card. Each of the pockets has an area outlined in a broken line, respectively designated 14' and 15', on the surface thereof, coated with a pressure-sensitive adhesive. Thus, when the pockets of the envelope are folded over and pressed together the hinge portion 16 forms a loop. As shown in FIG. 8, the envelope 13 is normally carried inside umbrella 17, when raised or when collapsed, with several sets of tubes 10 and caps 11, by inserting one end or pocket of the envelope under the rib 18 of the umbrella and then folding the pockets over and pressing them together. The envelope 13 is thus conveniently anchored inside the umbrella cover 19, with the rib 18 extending through the loop formed between the pockets of the envelope, easily accessible and available for use of a set of the tubes and caps when needed.

While I have shown the pressure-sensitive adhering areas for holding the pockets of the envelope together, other more costly means such as snap-fasteners may be employed if desired.

Referring to FIGS. 4–7, the manner of installation of a tube 10 and cap 11 will now be explained. If the umbrella rib 18' is of the type having a separate removable tip (not shown) the initial step is to slip the removable tip off the end of the umbrella rib at which separation of the cover 19 from the rib has occurred. As shown in FIG. 4, a cylindrical end portion 20 is exposed at the end, when the separate tip is removed. If the umbrella rib is of the type having a cylindrical end portion integral with the rib, then it is unnecessary to remove the separable tip.

In either case, I utilize this end portion 20 on which to telescopically slip a tube 10, as shown in FIG. 5. Each tube 10 has a hole 10' therein which is slightly smaller in diameter than the outer diameter of the end portion 20, thus requiring the tube to be expanded over the end portion. Since the tube is flexible and resilient, this is readily accomplished manually without any tools.

With the umbrella in its collapsed state, the edge of the umbrella cover 19 is then pressed over and in part around the tube 10, as shown in FIG. 6. By holding, with one hand, the rib 18' and cover 19 in the position shown in FIG. 6, the other hand then is used to screw the cap 11 over the tube 10 with the cover 19 intervening therebetween, into the final position shown in FIG. 7.

Since the tube 10 is expanded over the end portion 20 of the rib 18' it frictionally grips the rib, and the circumferential pressure exerted on the tube 10 by the cap 11 when screwed into place further secures the tube against separation from the rib 18' when the umbrella cover 19 is subsequently stretched into the raised position of the umbrella as shown in FIG. 8.

After the installation of a set of tubes and caps, as just described, the envelope 13 with additional sets of tubes and caps in the pockets thereof is restored to its position on the rib 18 inside the umbrella 17, as shown in FIG. 8, ready for possible subsequent need and use.

It will be seen that I have provided an umbrella tip repair kit of heretofore unattained simplicity and ease of installation and which, at the same time, includes a means of storage of several sets of parts which lends itself to easy and quick accessibility for immediate use.

I claim:

1. An umbrella tip repair kit of the type for manually securing an umbrella cover to the tip of an umbrella rib, wherein the kit comprises a short section of flexible tube adapted to be manually expanded over and frictionally grip the cylindrical end of the rib, and a separate screw cap adapted to be screwed over said tube with a peripheral section of the umbrella cover therebetween, said screw cap compressing said tube on the umbrella rib.

2. An umbrella tip repair kit according to claim 1, further comprising an envelope for containing a plurality of sets of tubes and caps, said envelope being adapted to be attached to the rib of an umbrella inside the cover thereof.

3. An umbrella tip repair kit according to claim 1, further comprising an envelope for containing a plurality of sets of tubes and caps, said envelope comprising two pocket portions having respective open ends facing each other and connected by a hinge portion adapted to be folded around the rib of an umbrella to close the open ends of the pocket portions, and means for releasably holding said pocket portions in side-by-side position while folded together.

4. An umbrella tip repair kit according to claim 1, further comprising an envelope for containing a plurality of sets of tubes and caps, said envelope being made of clear flexible plastic sheet material formed into two opposed open pocket portions connected by a hinge portion adapted to form a pocket closure loop by which to attach said envelope to an umbrella rib when the two pocket portions are folded together, and means for releasably holding said pocket portions in their folded together position.

5. An umbrella tip repair kit according to claim 3, wherein said means for holding said pocket portions together comprises areas on each of said two pocket portions coated with pressure-sensitive adhesive which causes said pocket portions to releasably adhere.

* * * * *